US008599096B2

(12) United States Patent
Angseryd

(10) Patent No.: US 8,599,096 B2
(45) Date of Patent: Dec. 3, 2013

(54) ANTENNA ATTACHMENT ARRANGEMENT, A MODULE COMPRISING SUCH AN ARRANGEMENT AND AN ANTENNA MAST ARRANGEMENT

(75) Inventor: Jan Angseryd, Täby (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 337 days.

(21) Appl. No.: 13/123,747

(22) PCT Filed: Apr. 27, 2010

(86) PCT No.: PCT/EP2010/055632

§ 371 (c)(1),
(2), (4) Date: Apr. 12, 2011

(87) PCT Pub. No.: WO2011/127988

PCT Pub. Date: Oct. 20, 2011

(65) Prior Publication Data

US 2011/0285605 A1 Nov. 24, 2011

Related U.S. Application Data

(60) Provisional application No. 61/324,027, filed on Apr. 14, 2010.

(51) Int. Cl.
*H01Q 21/00* (2006.01)

(52) U.S. Cl.
USPC ..... 343/879

(58) Field of Classification Search
USPC ..... 343/874, 879, 882, 890
See application file for complete search history.

(56) References Cited

U.S. PATENT DOCUMENTS

| | | | | |
|---|---|---|---|---|
| 6,028,566 | A * | 2/2000 | Pennell et al. | 343/878 |
| 6,088,002 | A * | 7/2000 | Johnson et al. | 343/878 |
| 6,222,502 | B1 * | 4/2001 | Falbo et al. | 343/879 |
| 6,353,419 | B1 | 3/2002 | Gates | |
| 6,864,853 | B2 * | 3/2005 | Judd et al. | 343/844 |
| 2004/0027307 | A1 * | 2/2004 | Hossein | 343/890 |
| 2004/0032375 | A1 * | 2/2004 | Ianello et al. | 343/890 |

FOREIGN PATENT DOCUMENTS

| | | | |
|---|---|---|---|
| DE | 9010416.1 | U1 | 10/1990 |
| EP | 1753075 | A1 | 2/2007 |
| FR | 2745423 | A1 | 8/1997 |
| FR | 2818810 | A1 | 6/2002 |
| FR | 2850418 | A1 | 7/2004 |
| WO | 9853521 | A1 | 11/1998 |
| WO | 0115265 | A1 | 3/2001 |

* cited by examiner

*Primary Examiner* — Seung Lee
(74) *Attorney, Agent, or Firm* — Coats and Bennett PLLC

(57) ABSTRACT

An antenna attachment arrangement (2) comprising first and second separate attachment points (4, 6) for an antenna (8) is provided. The first and second attachment points (4, 6) each comprise an attachment device and a clamping device removably attached to the attachment device. The clamping devices are arranged for attachment to an antenna (8) or a fastening arrangement of an antenna (8). There area at least two selectable positions for the antenna (8). There is also provided a module (30) for carrying an antenna (8) of a telecommunication system, comprising a substantially vertically extending central arrangement (32) and an antenna attachment arrangement (2).

13 Claims, 6 Drawing Sheets

ANTENNA ATTACHMENT ARRANGEMENT, A MODULE COMPRISING SUCH AN ARRANGEMENT AND AN ANTENNA MAST ARRANGEMENT

TECHNICAL FIELD

The present invention relates to an antenna attachment arrangement for an antenna, in particular an antenna of a wireless communication system. The invention further relates to a module for carrying an antenna of a telecommunication system comprising an antenna attachment arrangement. The invention further relates to an antenna mast arrangement comprising such a module.

BACKGROUND

An antenna mast for a wireless communication system is provided with one or more antennas at its upper end. The antennas may be of one type only or of different types and may be adapted to perform different functions in the wireless communication system. An example of such a function may be communication between a mobile communication device and a radio base station arranged in or at an antenna mast. Antennas performing this function are sometimes called sector antennas. A different example is communication between a radio base station in or at a relevant antenna mast and a radio base station at a different location than the relevant antenna mast.

Antenna masts may be constructed using different techniques. Examples are: steel lattice masts, masts comprising one or more steel tubes and masts comprising one or more reinforced concrete tubes. Accordingly, the expression "antenna mast" is intended to encompass antenna masts with an open structure, such a lattice, as well as masts with a closed structure such as a tubular mast, in the form of a tower.

The antennas at the top end of an antenna mast may be arranged so as to be fully visible or enclosed in a so-called radome. A radome may conceal the antennas from public view and accordingly prevent theft and damage of the antennas. A radome may also protect the antennas against influences of weather to a certain extent. A radome may be made from a glass fibre reinforced material.

Antennas of wireless communication systems may also be arranged on other buildings than dedicated masts. They may for instance be arranged on roof tops of office buildings or residential blocks. Also when arranged on a roof top, the antennas may be attached to a structure, e.g. a steel lattice construction.

DE 20 2005 010 140 U1 discloses an antenna construction wherein the antennas at the top of the construction are arranged inside an outer shell made from a material permeable to radio waves in the range of the antennas. According to one embodiment the antennas are attached to a pipe arranged centrally inside the outer shell.

DE 9407220 U1 and FR 2850418 disclose telecommunication antenna masts provided with several platforms for carrying antennas at their upper ends.

The positions of antennas of wireless communications systems must be able to be adjusted. In particular the sector antennas, each of which is arranged to cover a sector around e.g. an antenna mast or a module carrying antennas, often need to be adjusted in more than one direction. An antenna must be positioned and secured at least when installed for the first time to an antenna mast or in a module carrying antennas.

SUMMARY

An object of the present invention is to provide an arrangement for attaching antennas of a telecommunication system.

According to an aspect of the invention, the object is achieved by an antenna attachment arrangement comprising first and second separate attachment points for an antenna, in particular an antenna of a wireless communication system. The first attachment point comprises a first attachment device and a first clamping device releasably attached to the first attachment device. The second attachment point comprises a second attachment device and a second clamping device releasably attached to the second attachment device. The first clamping device and the second clamping device are arranged for attachment to an antenna or a fastening arrangement of an antenna. The first attachment device, the first clamping device, the second attachment device and the second clamping device are adapted for positioning and securing an antenna in one position out of at least two selectable positions.

Since the first clamping device is releasably attached to the first attachment device and the second clamping device releasably attached to the second attachment device the clamping devices may easily be attached in a desired position to each respective attachment device. An antenna may thus be easily positioned in a desired position. As a result, the above mentioned object is achieved. It is remarked that such positioning may be performed when an antenna is mounted to the attachment structure for the first time as well as when an already mounted antenna needs to be repositioned.

Herein, the term "at least two selectable positions" encompasses discrete positions, such as when a device is fixed in one out of two or more bolting positions, as well as the possibility of selecting two or more positions freely along an axis, such as when a device is fixed in a position along a slot or a rail.

According to a further aspect of the invention there is provided a module for carrying an antenna of a telecommunication system, which comprises a substantially vertically extending central arrangement and an antenna attachment arrangement comprising first and second separate attachment points for an antenna, in particular an antenna of a wireless communication system. The first attachment point comprises a first attachment device and a first clamping device releasably attached to the first attachment device. The second attachment point comprises a second attachment device and a second clamping device releasably attached to the second attachment device. The first clamping device and the second clamping device are arranged for attachment to an antenna or a fastening arrangement of an antenna. The first attachment device, the first clamping device, the second attachment device and the second clamping device are adapted for positioning and securing an antenna in one position out of at least two selectable positions.

Again, since the first clamping device is releasably attached to the first attachment device and the second clamping device releasably attached to the second attachment device, the clamping devices may easily be attached in a desired position to each respective attachment device. An antenna may thus be easily arranged on the module and positioned in a desired position. As a result, the above mentioned object is achieved.

According to example embodiments, the first attachment device and the first clamping device may be arranged above the second attachment device and the second clamping device on the central arrangement of the module. In this manner an antenna may easily be positioned in one or more directions and secured in such a direction.

According to example embodiments, the first attachment device and the first clamping device may be positioned in one position out of at least two selectable positions in relation to the central arrangement separate from the second attachment device and the second clamping device. Similarly, the second attachment device and the second clamping device may be positioned in one position out of at least two selectable positions in relation to the central arrangement separate from the first attachment device and the first clamping device. In this manner positioning of an antenna may be performed separately at two ends of the antenna.

According to example embodiments the central arrangement may be in the form of a pipe section, which may comprise a climbing arrangement arranged inside the pipe section. The central arrangement, particularly in the form of a pipe section, may be provided with a passage opening for personnel at a first end of the pipe section. The first end of the pipe section may be an upper and of the pipe section. In this manner service personnel may stand on the climbing arrangement inside the pipe section and reach out from the pipe section through the passage opening when handling, adjusting or positioning the antennas. Service personnel may thus perform at least part of such work safely standing inside the pipe section and do not have to exit the module for such work.

According to example embodiments there may be provided an access opening at a second end of the pipe section for accessing the second attachment device. The second end of the pipe section may be a lower end of the pipe section. In this manner service personnel may handle or adjust a lower end of an antenna arranged on the outside of the pipe section from inside the pipe section. Again, service personnel may not be required to leave the module for performing certain work on the antennas outside the module and thus, may work safely from within the module.

According to a further aspect of the invention there is provided an antenna mast arrangement, comprising an antenna mast body and a module for carrying an antenna of a telecommunication system as mentioned above arranged at an upper end of the antenna mast body.

An antenna may easily be positioned in a desired direction and secured in this position to the module of such an antenna mast arrangement.

Further features of, and advantages with, the present invention will become apparent when studying the appended claims and the following description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Well-known functions or constructions may not be described in detail for brevity and/or clarity.

Figure 1:
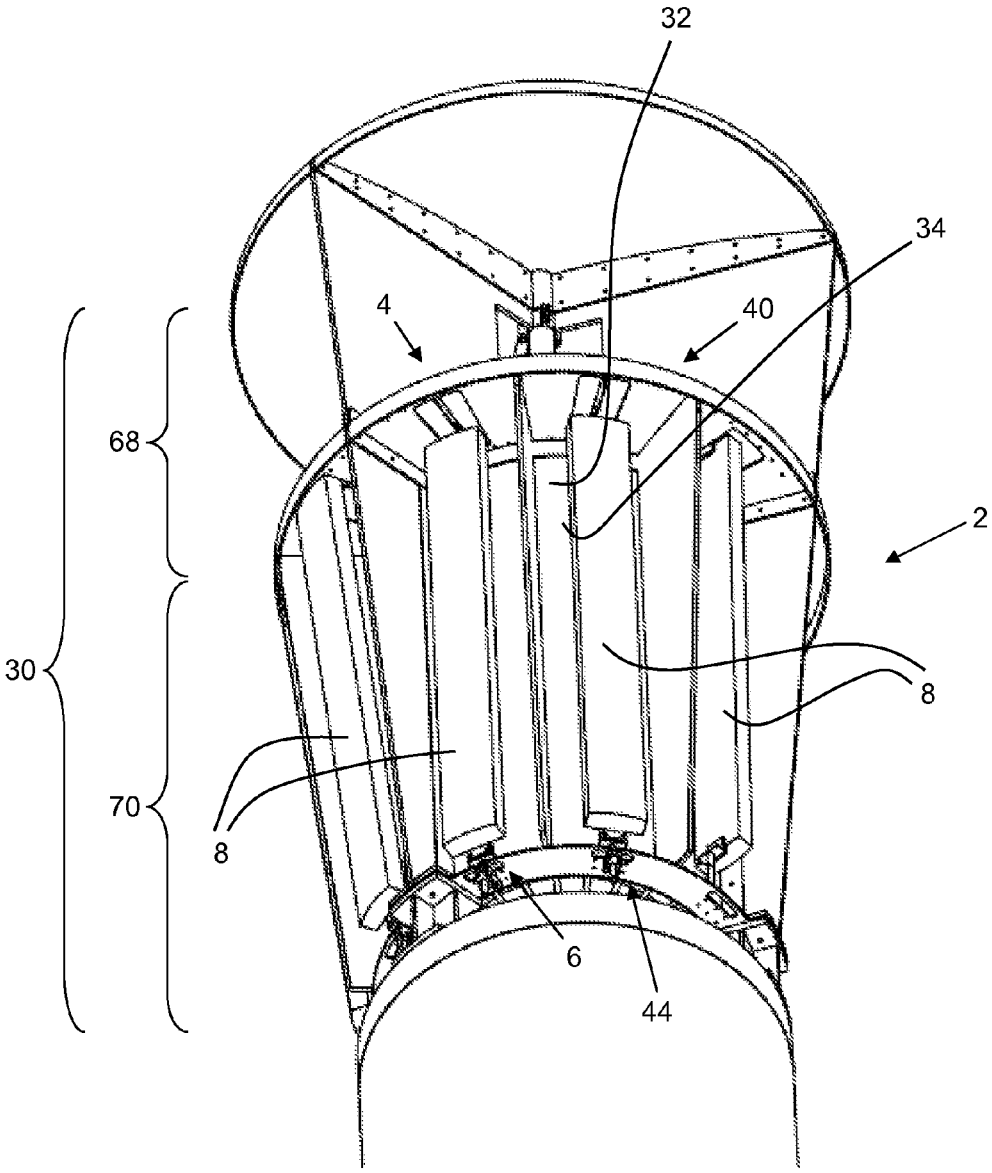
FIG. 1 illustrates a module according to example embodiments comprising an antenna attachment arrangement according to example embodiments provided with first and second separate attachment points.

FIG. 1 illustrates a module 30 according to example embodiments comprising an antenna attachment arrangement 2 according to example embodiments provided with first and second separate attachment points 4, 6.

The module 30 has an upper part 68 and a lower part 70. In the lower part there is a vertically extending central arrangement 32 in the form of a pipe section 34. At a first end 40 of the pipe section 34 there are arranged the first separate attachment points 4 of the antenna attachment arrangement 2. At a second end 44 of the pipe section 34 there are arranged the second separate attachment points 6 of the antenna attachment arrangement 2. Antennas 8 are attached at their both ends by means of the first and second attachment points 4, 6 of the attachment arrangement 2 of the module 30.

Figure 2:
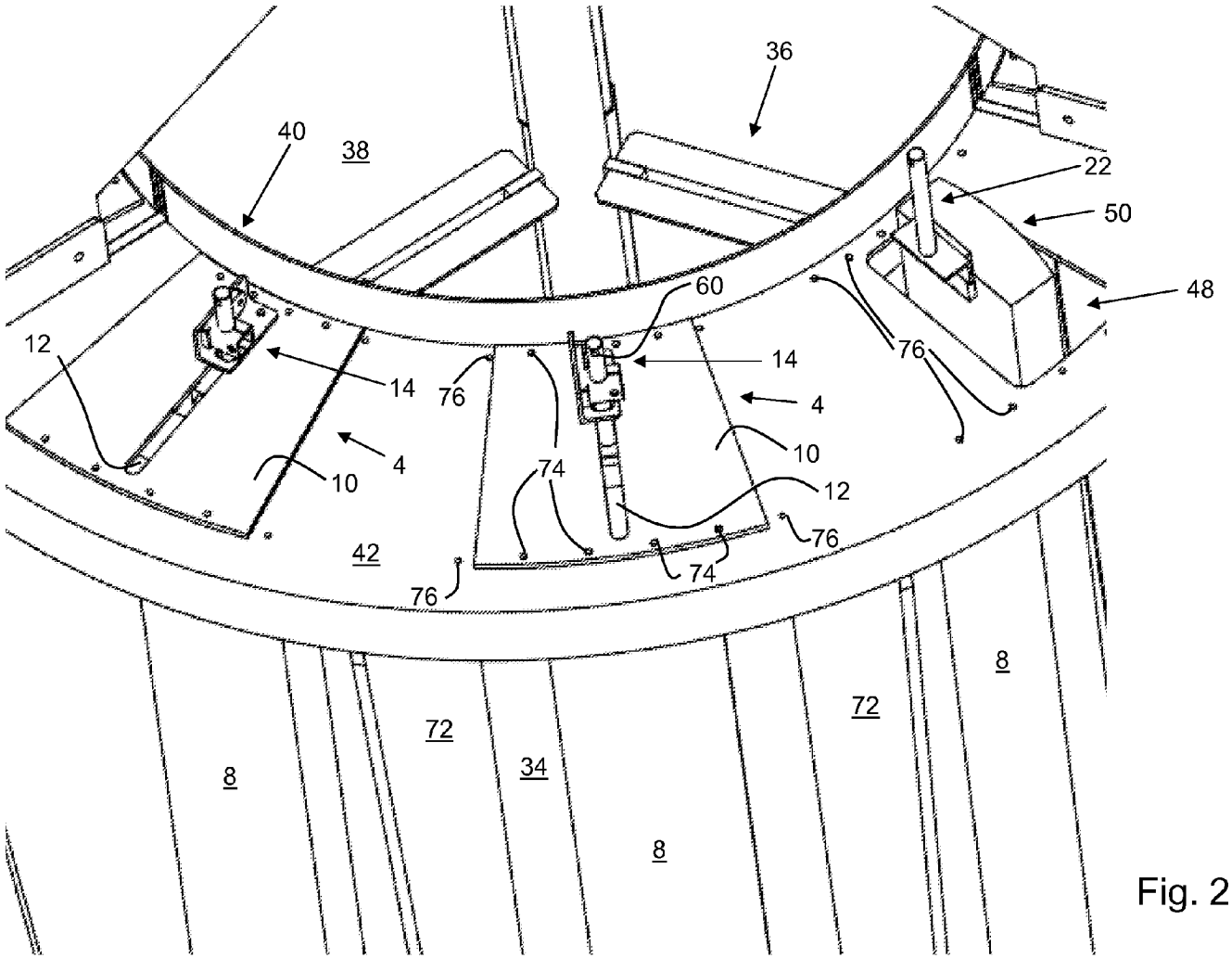
FIG. 2 illustrates first attachment points according to example embodiments of an antenna attachment arrangement according to example embodiments arranged on a module according to example embodiments.

FIG. 2 illustrates first attachment points 4 according to example embodiments of an antenna attachment arrangement 2 according to example embodiments arranged on a module 30 according to example embodiments. (For improved legibility, bolts have been omitted from the figure.)

The module 30 has a pipe section 34 with a first end 40, which is the upper end of the pipe section 34. The pipe section 34 has a first flange 42 at the first end 40. The first attachment points 4 are arranged on the first flange 42. Antennas 8 are attached to the attachment arrangement 2 and the module 30 inter alia by means of the first attachment points 4. Between the antennas 8 there are arranged wall portions 72. The wall portions 72 may define an outer contour of the module 30. The pipe section 34, at its first end 40 is provided with a passage opening 38, and on its inside is provided with a climbing arrangement 36 comprising steps. Service personnel may stand on one step inside the pipe section 34 while working with the antennas 8 and the first attachment points 4 outside the pipe section 34.

On the right hand side of FIG. 2 it is illustrated how a first end 50 of an antenna 8 and a fastening arrangement 22 of the antenna 8 extends through a third through hole 48 of the first flange 42. When in this position, a fastening arrangement 22 at a second end 52 (see FIG. 3) of the antenna 8 may be inserted into a second through hole 18 (see FIG. 3). The antenna 8 is lowered to be positioned in the second through hole 18. Thereafter a first attachment device 10 of a first attachment point 4 is placed over the fastening arrangement 22 at the first end 50 of the antenna 8, and a first clamping device 14 is clamped to the fastening arrangement 22 at the first end 50 of the antenna 8. Service personnel may aim the antenna 8 in a desired direction. This is facilitated by an aiming arrangement 60 in the form of a through hole in the fastening arrangement 22, which through hole points in the same direction as the antenna 8.

The first attachment device 10 may be bolted to the first flange 42 in three different positions by means of boltholes 74 in the first attachment device 10, which are aligned with relevant boltholes 76 in the first flange 42. The first clamping device 14 is secured in a position along the first through hole 12 in the form of a slot of the first attachment device 10 such that the relevant antenna 8 is tilted at a desired angle.

Figure 3:
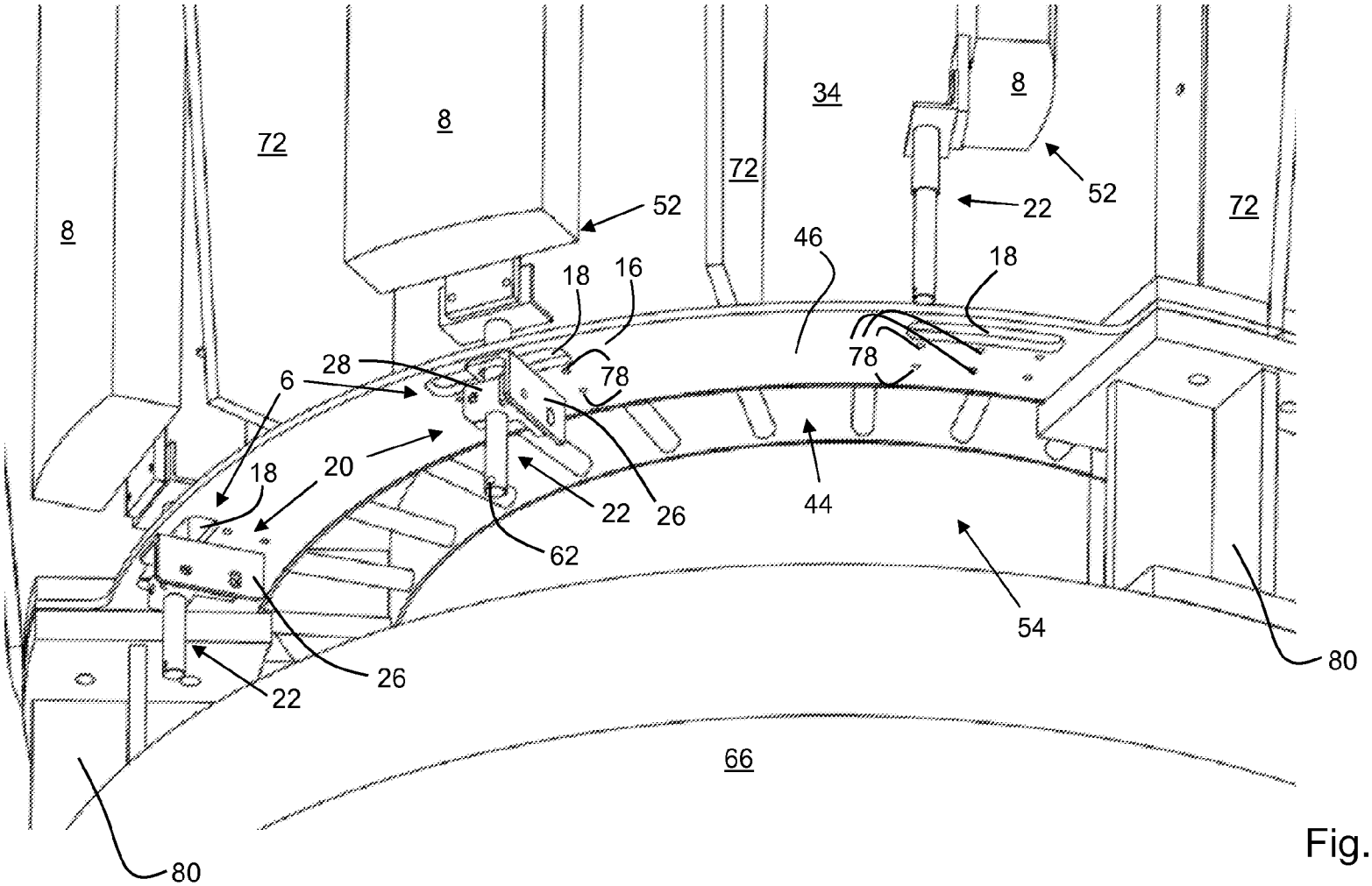
FIG. 3 illustrates second attachment points according to example embodiments of an antenna attachment arrangement according to example embodiments arranged on a module according to example embodiments.

FIG. 3 illustrates second attachment points 6 according to example embodiments of an antenna attachment arrangement 2 according to example embodiments arranged on a module 30 according to example embodiments. (For improved legibility, bolts have been omitted from the figure.) FIG. 3 illustrates a second end 44, which is a lower end of the pipe section 34 illustrated in FIG. 2.

The pipe section 34 has a second flange 46 at the second end 44. The second attachment points 6 are arranged on the second flange 44. Antennas 8 are attached to the attachment arrangement 2 and the module 30 by means of the second attachment points 6 and the first attachment points 4 (illustrated in FIG. 2). Between the antennas 8 there are arranged wall portions 72. At the second end 44 of the pipe section 34 there is arranged an access opening 54, through which service personnel may reach the second flange 46 and the second attachment points 6. The access opening 54 may be closed by means of a door or a hatch.

On the right hand side of FIG. 3 it is illustrated how a second end 52 of an antenna 8 and a fastening arrangement 22 of the antenna 8 is positioned above a second through hole 18 in the second flange 46. The second flange 46 forms a second attachment device 16 but a separate attachment device similar to the first attachment device 10 may alternatively be used. The second through hole 18 is in the form of a slot. When in this position, the fastening arrangement 22 at a second end 52 of the antenna 8 may be inserted into the second through hole 18 by lowering the antenna 8. Thereafter a second clamping device 20 is placed over the fastening arrangement 22 at the second end 52 of the antenna 8 and clamped to the second attachment device 16 and the fastening arrangement 22 at the second end 52 of the antenna 8. Service personnel may aim the antenna 8 in a desired direction. This is facilitated by an aiming arrangement 62 in the form of a through hole in the fastening arrangement 22.

The second clamping device 20 may be bolted to the second flange 46, i.e. the second attachment device 16, in three different positions by means of boltholes in the second clamping device 20, which are aligned with relevant boltholes 78 in the second flange 46.

The module 30, at its lower end, is provided with supports 80 by means of which the module 30 is attached to an antenna mast body 66 or other structure with the function of carrying the module 30. In this embodiment the access opening 54 is provided below the pipe section 34 between the supports 80.

Figure 4:
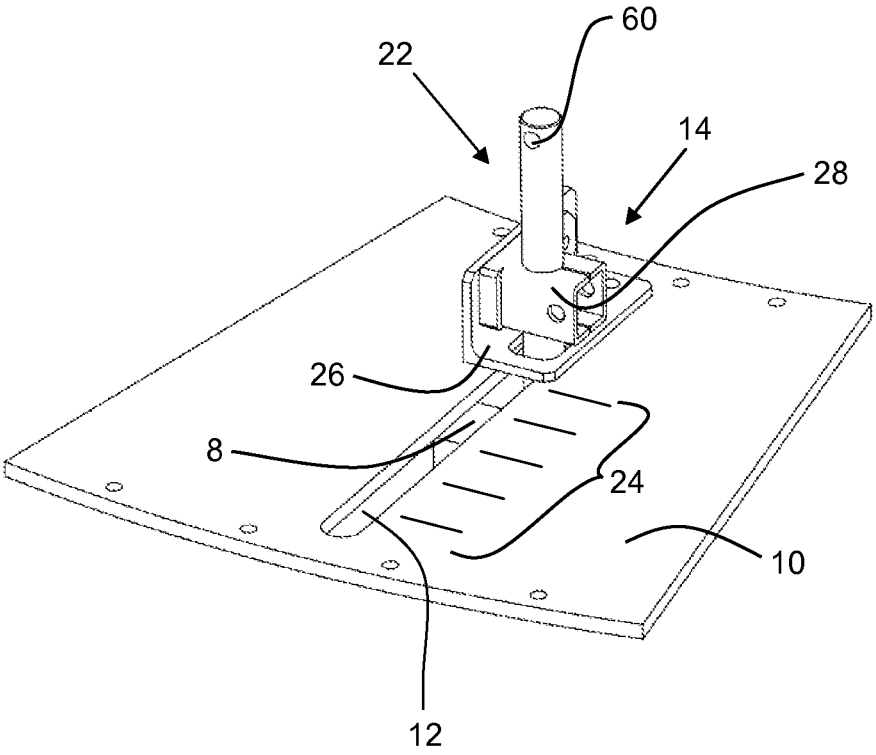
FIG. 4 illustrates a first attachment device and a first clamping device.

FIG. 4 illustrates a first attachment device 10 and a first clamping device 14. (For improved legibility, bolts have been omitted from the figure.) A fastening arrangement 22 of an antenna 8 is clamped to the first clamping device 14. The first clamping device 14 is connected to the first attachment devices 10.

The first clamping device 14 comprises a connection bar 26 and a clamping bar 28. The first attachment device 10 is provided with a first through hole 12 in the form of a slot. The first attachment device 10 is graded with a scale 24 next to the slot for facilitating positioning of the antenna 8.

The fastening arrangement 22 extends through the slot, the connection bar 26 and the clamping bar 28. With loosened bolts, the connection bar 26 may be slid back and forth along the slot in the first attachment device 10 and fixed in a desired position by means of a bolt extending through the slot and a counter element on the opposite (non-shown) side of the attachment device 10. The connection bar 26 and the clamping bar 28 are also fixed in relation to each other by means of one or more bolts.

The second attachment device 16 and/or the second clamping device 20 may have the same or similar form as the first attachment device 10 and the first clamping device 14, respectively.

Figure 5:
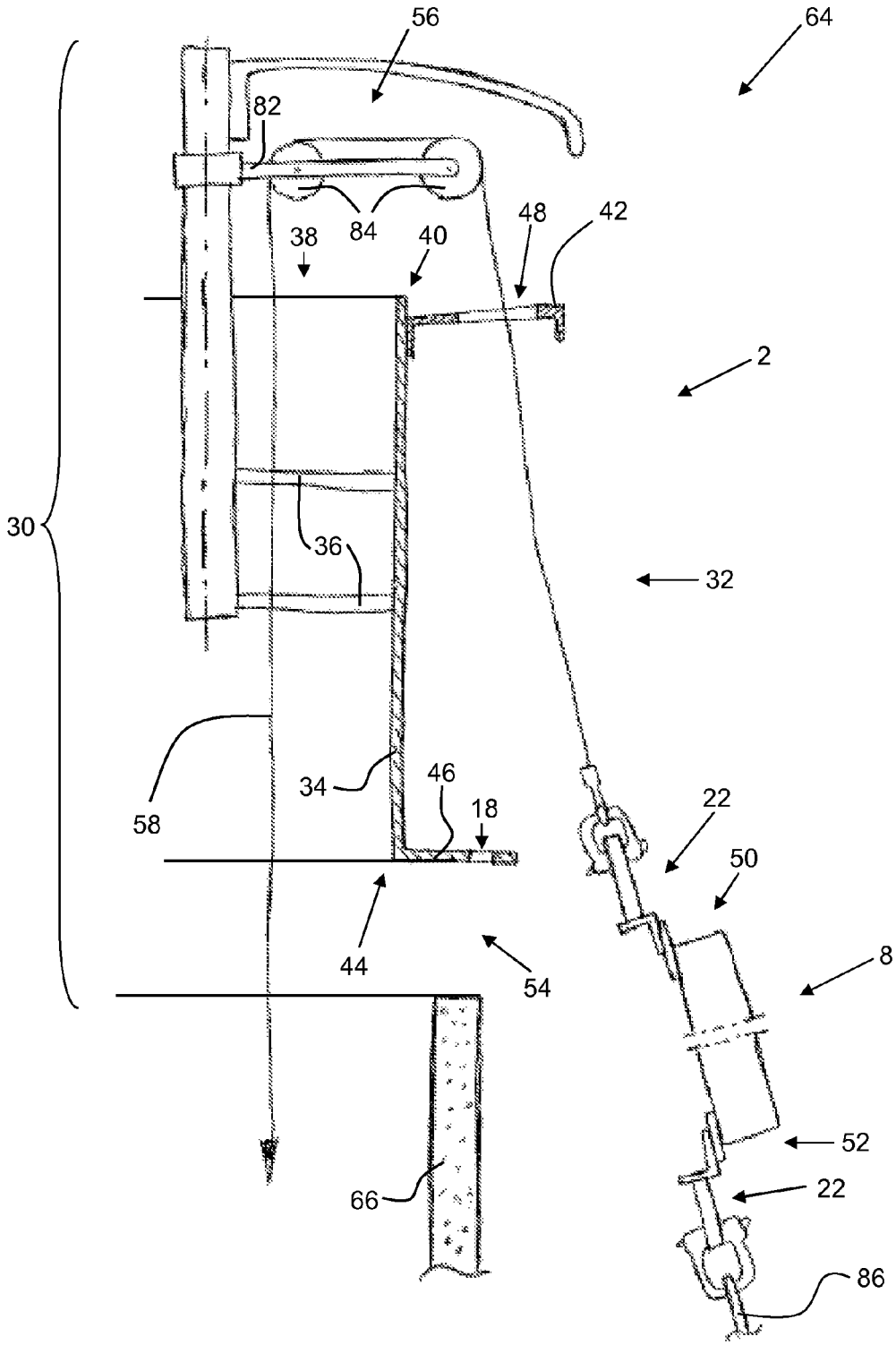
FIG. 5 illustrates a partial cross section of an antenna mast arrangement according to example embodiments during mounting of an antenna to an antenna attachment arrangement according to example embodiments, the antenna attachment arrangement being arranged on a central arrangement of a module according to example embodiments.

FIG. 5 illustrates a partial cross section of an antenna mast arrangement 64 according to example embodiments during mounting of an antenna 8 to an antenna attachment arrangement 2 according to example embodiments, the antenna attachment arrangement 2 being arranged on a central arrangement 32 of a module 30 according to example embodiments. The central arrangement 32 comprises a pipe section 34, which at a first end 40 is provided with a first flange 42 and at a second end 44 is provided with a second flange 46.

The module 30 comprises part of a winch arrangement 56, in this case a bar 82 and pulleys 84. A wire 58 of the winch arrangement 56 extends over the pulleys 84 through a third through hole 48 in the first flange 42. The winch arrangement 56 may be motor driven or manually driven.

When lifting an antenna 8 to the module 30, the wire 58 is attached to the antenna 8, e.g. through an aiming arrangement 60 hole in a fastening arrangement 22 at a first end 50 of the antenna 8. By means of the winch arrangement 56 the antenna 8 is winched up to the module 30 and partially through the third through hole 48. In order to prevent the antenna 8 from dangling freely when it is winched up, a rope 86 may be attached to a fastening arrangement 22 at a second end 52 of the antenna 8, e.g. through an aiming arrangement 62 hole. A person may hold the rope 86 tight during the winching.

When the antenna 8 has reached the position illustrated by the right hand antenna 8 in FIG. 2, the rope 86 is removed. An antenna 8 in this position with the rope 86 removed is illustrated by the right hand antenna 8 in FIG. 3.

The antenna 8 is held by the wire 58 during attachment of the second end 52 of the antenna to the second attachment device 16. If dimensions are suitably chosen, the antenna 8 is prevented from falling down from the module 30 by means of the first end 50 of the antenna 8, or at least the fastening arrangement 22 at the first/upper end 50, extending through the third through hole 48 while, and after, attaching the second end 52 of the antenna to the second attachment device 16 and before the first attachment device 10 is attached to the first end 50 of the antenna 8. Attachment of the respective ends 50, 52 of the antenna 8 is achieved via the fastening arrangements 22 and the clamping devices 14, 20 to the attachment devices 10, 16.

Figure 6:
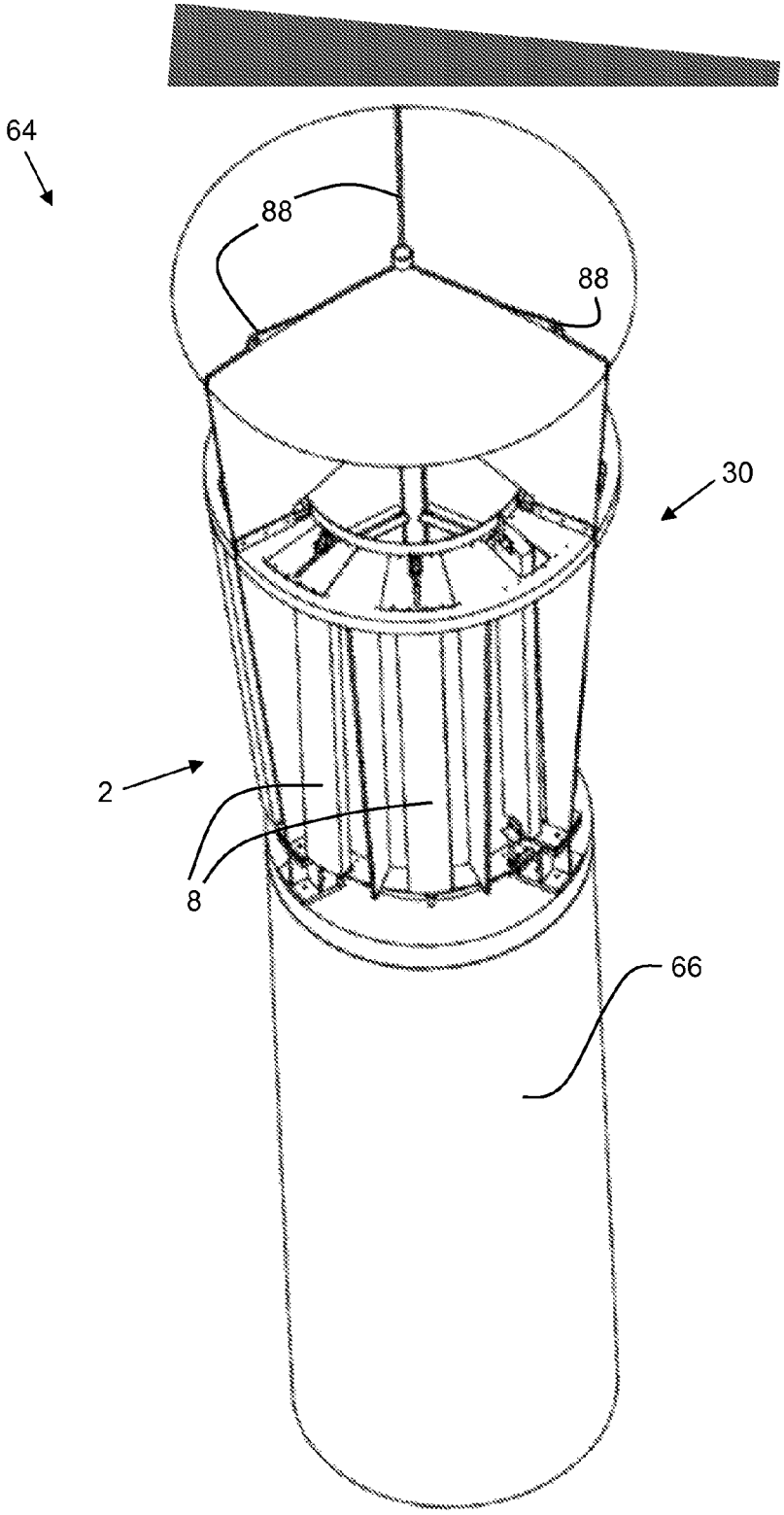
FIG. 6 illustrates an antenna mast arrangement according to example embodiments comprising a module according to example embodiments with an antenna attachment arrangement according to example embodiments.

FIG. 6 illustrates an antenna mast arrangement 64 according to example embodiments comprising a module 30 according to example embodiments with an antenna attachment arrangement 2 according to example embodiments. The antenna mast arrangement further comprises an antenna mast body 66, on top of which the module 30 is mounted. Antennas 8 are attached by means of the antenna attachment arrangement 2 to the module 30. The module 30 is provided with three lifting loops 88 for lifting an assembled module 30 onto the antenna mast body 66.

In the following reference is made to all of FIGS. 1-6.

According to example embodiments an antenna attachment arrangement 2 comprises first and second separate attachment points 4, 6 for an antenna 8, in particular an antenna 8 of a wireless communication system. The first attachment point 4 comprises a first attachment device 10 and a first clamping device 14 releasably attached to the first attachment device 10. The second attachment point 6 comprises a second attachment device 16 and a second damping device 20 releasably attached to the second attachment device 16. The first clamping device 14 and the second clamping device 20 are arranged for attachment to an antenna 8 or a fastening arrangement 22 of an antenna 8. The first attachment device 10, the first clamping device 14, the second attachment device 16 and the second clamping device 20 are adapted for positioning and securing an antenna 8 in one position out of at least two selectable positions.

According to example embodiments the first attachment device 10 may be provided with a first through hole 12. Also the second attachment device 16 may be provided with a second through hole 18. Through such through holes 12, 18 portions of antenna fastening arrangements 22 may extend. Alternatively, or in addition, such through holes may be utilized for attaching the first and/or second clamping devices 14, 20 to the first and second attachment devices 10, 16, respectively.

According to example embodiments the first through hole 12 of the first attachment device 10 may be in the form of a slot.

According to example embodiments the second through hole 18 of the second attachment device 16 may be in the form of a slot.

In such a slot of the first and/or second attachment devices 10, 16 for instance a fastening arrangement 22 of an antenna 8 may be continuously adjusted into a desired position, in which position the fastening arrangement 22 and thus the antenna 8 may be fixed, for instance by means of the first and second clamping devices 14, 20, respectively.

According to example embodiments the first clamping device 14 may be associated with the first through hole 12 of the first attachment device 10 and the second clamping device 20 may be associated with the second through hole 18 of the second attachment device 16. In this manner a fastening arrangement 22 of an antenna 8 may extend through a relevant through hole 12, 18 and be clamped by a respective clamping device 14, 20. One or both of the through holes 12, 18 may also function to attach a relevant clamping device 14, 20 to a relevant attachment device 10, 16.

According to example embodiments the slot of the first attachment device 10 and the slot of the second attachment device 16 may be arranged at an angle to each other, for instance at approximately a right angle. In this manner one of the slots may be utilized for adjusting the tilt of an antenna 8 and the other slot may be used for adjusting a lateral position of an end 50, 52 of the antenna 8.

According to example embodiments the slot of the first attachment device 10 may be provided with a scale 24 for facilitating angular adjustment of an antenna 8. The scale 24 may be marked on the first attachment device 10. There may also be provided a scale in connection with the slot of the second attachment device 16.

According to example embodiments each of the first and second clamping devices 14, 20 may comprise a connection bar 26 connected to the respective first and second attachment devices 10, 16 and a clamping bar 28 for the said attachment to an antenna 8 or a fastening arrangement 22 of an antenna 8. The respective connection bars 26, clamping bars 28, attachment devices 10, 16 and fastening arrangements 22 may be connected to each other by means of bolts, nuts, threaded holes, clasps etc.

According to example embodiments a module 30 for carrying an antenna 8 of a telecommunication system comprises a substantially vertically extending central arrangement 32 and an antenna attachment arrangement 2 according to any one of the above described example embodiments.

According to example embodiments the central arrangement may comprise a pipe section 34 at one end of the module 30. The pipe section 34 may be built up of several parts, such as arched wall sections or shorter pipe sections.

According to example embodiments the pipe section 34 may comprise a climbing arrangement 36 arranged inside the pipe section 34 and may be provided with a passage opening 38 for personnel at a first end 40 of the pipe section 34.

The passage opening 38 may allow a whole person to exit the pipe section 34. Alternatively, the passage opening 38 may allow only part of a person to reach outside the pipe section 34, such as the head and an arm of a person.

According to example embodiments the pipe section 34 at its first end 40 may be provided with a first flange 42 for attaching an antenna 8 to the module 30.

The first attachment point 4 thus may be arranged on or at the first flange 42. The first flange 42 may extend continuously around the first pipe section 34 or it may be a discrete flange, which only extends partially around the first pipe section 34. More than one such discrete flange may be arranged around the first pipe section 34. The first flange 42 may comprise the first attachment device 10, either forming a part of the first flange 42 or being attached to the first flange 42.

According to example embodiments the pipe section 34 at a second end 44 thereof may be provided with a second flange 46 for attaching an antenna 8 to the module 30.

The second attachment point 6 thus may be arranged on or at the second flange 46. The second flange 46 may extend continuously around the first pipe section 34 or it may be a discrete flange, which only extends partially around the first pipe section 34. More than one such discrete flange may be arranged around the first pipe section 34.

According to example embodiments the first flange 42 may be provided with a third through hole 48 for at least partial insertion of an antenna 8 and/or a fastening arrangement 22 of an antenna 8.

The possibility to at least partially insert the antenna 8 or the fastening arrangement 22 through the third through hole 48 greatly facilitates mounting of the antenna 8. When lifting the antenna 8 into position from an outside of the module 8, the antenna 8 and/or the fastening arrangement 22 may be inserted into the third through hole 48 and then lowered towards the second flange 46.

According to example embodiments the first attachment device 10 may be removably attached to the first flange 42. The first attachment device 10 may at least partially cover the third through hole 48 in the first flange 42. In this mariner the third through hole 48 may be uncovered during lifting in place of an antenna 8 and thereafter, when the antenna 8 is at an approximately correct vertical height, the first attachment device 10 may be attached to the first flange 42 and the antenna 8 or a fastening arrangement 22 of the antenna 8 may be attached to the first attachment device 10 by means of the first clamping device 14. For instance may the first attachment device 10 be bolted to the first flange 42 and the first clamping device 14 may be bolted to the first attachment device.

According to example embodiments the first attachment device 10 may be able to be positioned in one position of at least two selectable positions. For instance, the at least two selectable positions of the first attachment device 10 may be arranged in a circumferential direction of the pipe section 34. In this manner the first attachment device 10 forming part of the first attachment point 4 of the antenna 8 may be placed in a position suitable for directing the relevant antenna 8 in a desired direction.

According to example embodiments the slot in the first attachment arrangement 10 may be arranged radially with respect to the pipe section 34 such that a first end 50 of an antenna 8 is able to be positioned in one of at least two selectable positions in a vertical plane extending radially from the pipe section 34. In this manner the antenna may be tilted at a desired angle. When the slot is provided with a scale 24 an exact tilting of the antenna 8 may be facilitated.

According to example embodiments the second attachment device 16 may be attached to the second flange 46 or may be formed by the second flange 46.

According to example embodiments the slot of the second attachment device 16 may extend in a circumferential direction of the pipe section 34. A second end 52 of an antenna 8 may be able to be positioned in one of at least two selectable positions in the slot of the second attachment device 16. In this manner the antenna 8 may be placed in a position suitable for directing the antenna 8 in a desired direction.

According to example embodiments there may be provided an access opening 54 at the second end 44 of the pipe section 34 for access to the second flange 46 and/or the second attachment device 16. Service personnel may thus attach an antenna 8 from inside the pipe section 34 or from inside an antenna mast arrangement 64, to which the module 8 is attached. Also, a position of the antenna 8 may be adjusted from inside the pipe section 34 or from inside an antenna mast arrangement 64, to which the module is 8 attached.

According to example embodiments the module 30 may comprise at least part of a winch arrangement 56 for lifting an antenna 8 to the module 30. This may be done on the outside of the module 30 or an antenna mast arrangement 64. In this manner the often heavy and long antennas 8 (e.g. 45 kg and 2.6 m) may be conveniently handled.

According to example embodiments the winch arrangement 56 may be arranged such that a wire 58, a rope or a chain of the winch arrangement 56 may run through the third through hole 48 of the first flange 42. In this manner an antenna 8 may be lifted up and directly partially through the third through hole 48.

According to example embodiments a first antenna 8 at a first end 50 may be attached to the first attachment device 10 and at a second end 52 may be attached to the second attachment device 16. Such attachment may be achieved indirect via fastening arrangements 22 of the first antenna 8 and the first and second clamping devices 14, 20.

According to example embodiments the first antenna 8 may be provided with an aiming arrangement 60, 62 for aiming the first antenna 8 in a particular direction. Such an aiming arrangement may be formed by a through hole, e.g. in the fastening arrangement 22 of the first antenna 8, which through hole has the same direction as the antenna 8. Service personnel may insert at pen or screwdriver through the through hole to see in which direction the first antenna 8 is aimed and may perform adjustment of the direction while aiming.

According to example embodiments an antenna mast arrangement 64 comprises an antenna mast body 66 and a module 30 for carrying an antenna 8 of a telecommunication system according to any one of the above mentioned example embodiments arranged at an upper end of the antenna mast body 66.

Modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure and the appended claims. Although specific terms may be employed herein, they are used in a generic and descriptive sense only and not for purposes of limitation.

Example embodiments may be combined as understood by a person skilled in the art. Although the invention has been described with reference to example embodiments, many different alterations, modifications and the like will become apparent for those skilled in the art.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "coupled", "attached" or "connected" to another element, it can be directly coupled, attached or connected to the other element or intervening elements may also be present. In contrast, when an element is referred to as being "directly coupled", "directly attached" or "directly connected" to another element, there are no intervening elements present.

The invention claimed is:

1. A module configured to support an antenna of a wireless communication system, the module comprising:

a substantially vertically extending central arrangement that comprises a pipe section at one end of the module, wherein the pipe section includes an opening therein configured to accommodate service personnel and includes a first flange at a first end thereof; and an antenna attachment arrangement configured to secure said antenna to the module in one of at least two selectable positions, the antenna attachment arrangement comprising:

a first attachment point for said antenna that includes a first attachment device and a first clamping device, the first clamping device configured to:

attach to said antenna, or a fastening arrangement of the antenna; and removably attach to the first attachment device;

a second attachment point for said antenna that includes a second attachment device and includes a second clamping device configured to:

attach to said antenna, or a fastening arrangement of the antenna; and removably attach to the second attachment device;

wherein the first attachment device is configured to removably attach to the first flange and includes a slot arranged radially with respect to the pipe section, an end of said antenna thereby movable to any of at least two selectable positions in a vertical plane extending radially from the pipe section.

2. The module according to claim 1, wherein at least one of the first and second clamping devices comprises a connection bar configured to connect to either the first or second attachment device, respectively, and a clamping bar configured to attach to said antenna, or a fastening arrangement of the antenna.

3. The module according to claim 1, wherein the first flange includes a through hole configured to receive at least a part of said antenna, or a fastening arrangement of said antenna.

4. The module according to claim 1, wherein the pipe section includes a second flange at a second end thereof, and wherein the second attachment device is attached to the second flange or is formed by the second flange.

5. The module according to claim 1, wherein the second attachment device includes a slot, and wherein an end of said antenna is movable to any of at least two selectable positions in said slot of the second attachment device.

6. The module according to claim 1, wherein the module includes at least part of a winch arrangement configured to lift said antenna to the module, the winch arrangement including a wire running through a through hole of the first flange.

7. The module according to claim 1, wherein the first clamping device is configured to attach to a first end of said antenna, or a fastening arrangement at that end of the antenna, and the second clamping device is configured to attach to a second end of said antenna, or a fastening arrangement at that end of the antenna.

8. The module according to claim 1, wherein said antenna includes an aiming arrangement configured to aim said antenna in a particular direction.

9. An antenna mast arrangement comprising an antenna mast body and a module arranged at an upper end of the antenna mast body, wherein the module is configured to support an antenna of a wireless communication system and comprises:

a substantially vertically extending central arrangement that comprises a pipe section at one end of the module, wherein the pipe section includes an opening therein configured to accommodate service personnel and includes a first flange at a first end thereof; and an antenna attachment arrangement configured to secure said antenna to the module in one of at least two selectable positions, the antenna attachment arrangement comprising:

a first attachment point for said antenna that includes a first attachment device and a first clamping device, the first clamping device configured to:

attach to said antenna, or a fastening arrangement of the antenna; and removably attach to the first attachment device;

a second attachment point for said antenna that includes a second attachment device and includes a second clamping device configured to:

attach to said antenna, or a fastening arrangement of the antenna; and removably attach to the second attachment device;

wherein the first attachment device is configured to removably attach to the first flange and includes a slot arranged radially with respect to the pipe section, an end of said antenna thereby movable to any of at least two selectable positions in a vertical plane extending radially from the pipe section.

10. The antenna mast arrangement according to claim 9, wherein at least one of the first and second clamping devices comprises a connection bar configured to connect to either the first or second attachment device, respectively, and a clamping bar configured to attach to said antenna, or a fastening arrangement of the antenna.

11. The antenna mast arrangement according to claim 9, wherein the first flange includes a through hole configured to receive at least a part of said antenna, or a fastening arrangement of said antenna.

12. The antenna mast arrangement according to claim 9, wherein the pipe section includes a second flange at a second end thereof, and wherein the second attachment device is attached to the second flange or is formed by the second flange.

13. The antenna mast arrangement according to claim 9, wherein the second attachment device includes a slot, and wherein an end of said antenna is movable to any of at least two selectable positions in said slot of the second attachment device.

* * * * *